United States Patent [19]

Goldfarb

[11] Patent Number: 4,825,556

[45] Date of Patent: May 2, 1989

[54] APPARATUS FOR DRAWING COMPOUND DESIGNS, WITH OFFSETTING, SIZE-VARYING, SKEWING, AND DISTORTING ADJUSTMENTS

[76] Inventor: Adolph E. Goldfarb, 1432 South East Wind Circle, Westlake Village, Calif. 91361

[21] Appl. No.: 150,028

[22] Filed: Jan. 29, 1988

[51] Int. Cl.[4] ..... B43L 11/00

[52] U.S. Cl. ..... 33/27.11; 33/18.1

[58] Field of Search ..... 33/27.1, 27.11, 27.09, 33/27.01, 18.1

[56] References Cited

U.S. PATENT DOCUMENTS

| | | | |
|---|---|---|---|
| 1,763,885 | 6/1930 | Fisher | 33/27.11 |
| 2,579,290 | 12/1951 | Bachmann | 33/27.11 |
| 3,256,606 | 6/1966 | Horta | 33/27.11 |
| 3,468,032 | 9/1969 | Smith | 33/27.11 |
| 4,441,256 | 4/1984 | Cummings et al. | 33/27.11 |
| 4,662,073 | 5/1987 | Prusman | 33/27.11 |

*Primary Examiner*—William D. Martin, Jr.
*Attorney, Agent, or Firm*—Ashen, Golant, Martin & Seldon

[57] ABSTRACT

This amusement device is for use with paper and one or more pens, to draw compound plural-lobe designs. It has a base and a paper carriage mounted to the base for, ideally, rotation through a complete design-drawing motion. A pen-holding arm preferably has a motion-imparting fitting at one end, and a longitudinal slot partway between the ends. A pivot pin, movable on the base, engages the slot to provide a fixed arm-pivot axis. The pen holder performs repetitive excursions which each define a single element or lobe of a design, with a fixed ratio between number of excursions and number of complete design-drawing motions. To provide this co-ordination the motional fitting on the arm is linked mechanically to the carriage—in such a way (preferably using toothed gears) as to be manually offset-table in fixed increments, for redrawing a design offset by fixed steps along the carriage operating direction to make a compound design. Design-element lobes are moved radially by use of various pen positions on the arm; sized by shifting an eccentric drive pin radially on a drive gear, and by shifting the pivot pin relative to the carriage/drive-gear line of centers; skewed by offsetting the pivot pin from the line of centers; arbitrarily deformed by a cam on the drive gear; and varied in number by change of drive gears.

28 Claims, 6 Drawing Sheets

FIG. 3.
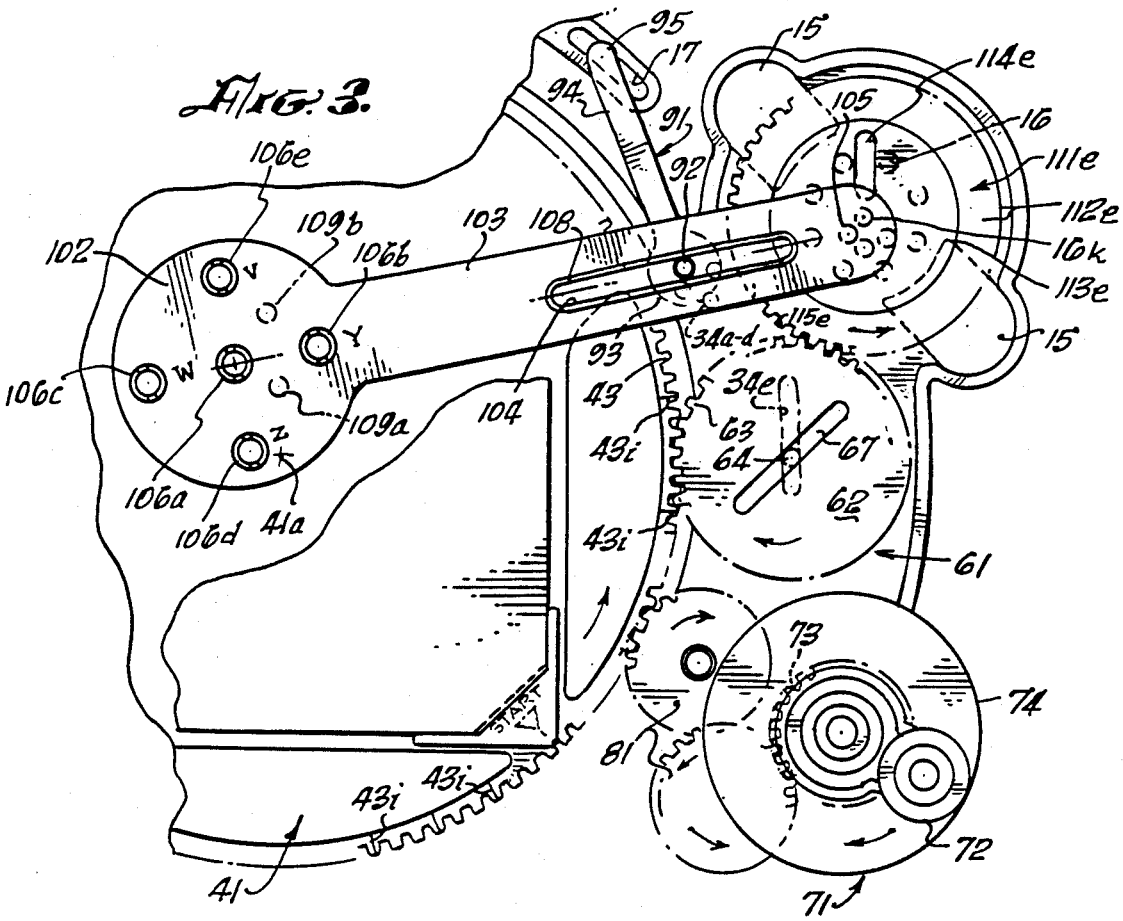
FIG. 4.
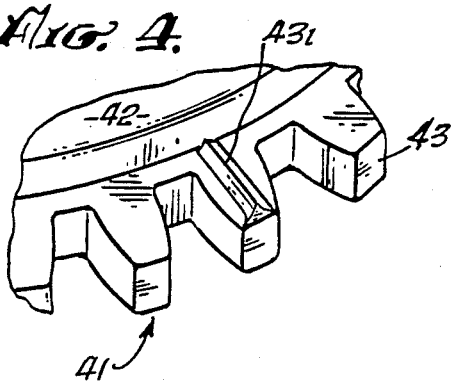
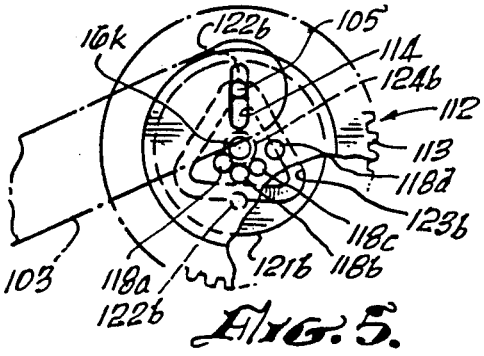
FIG. 5.
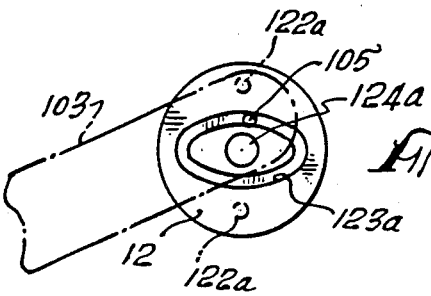
FIG. 6.

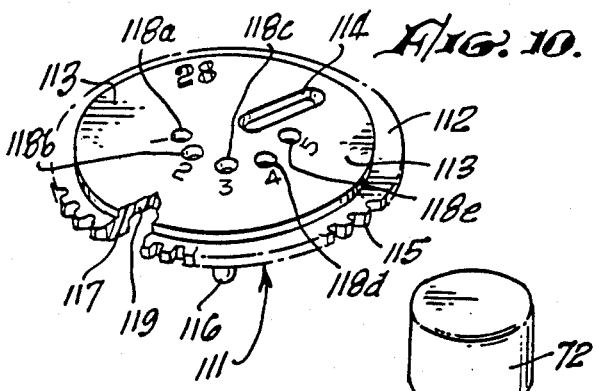
FIG. 10.
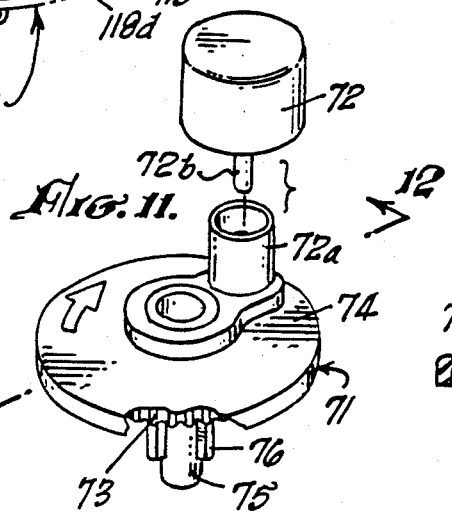
FIG. 11.
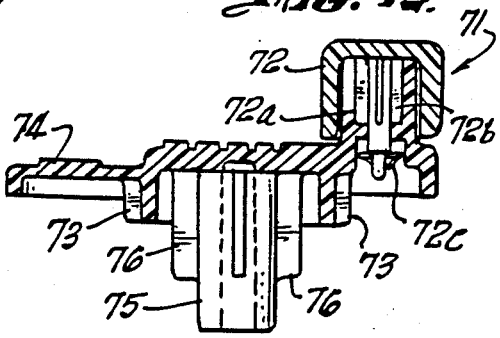
FIG. 12.
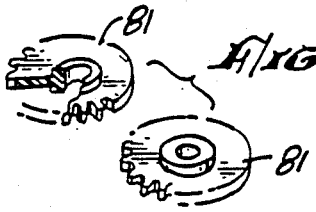
FIG. 13.
FIG. 14.
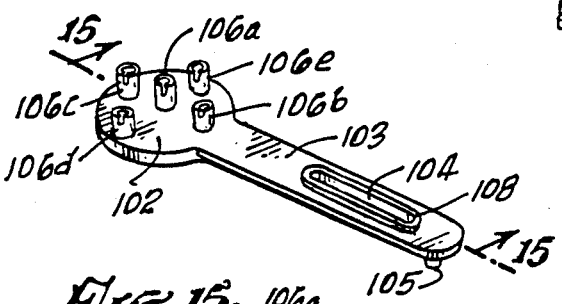
FIG. 15.
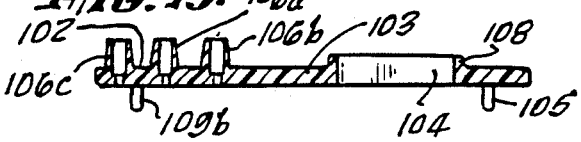
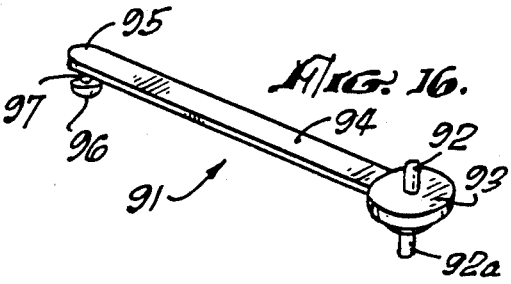
FIG. 16.
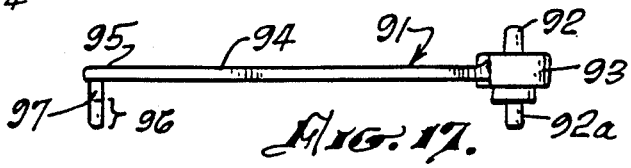
FIG. 17.
FIG. 18.
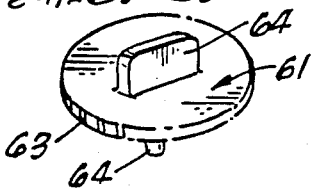

APPARATUS FOR DRAWING COMPOUND DESIGNS, WITH OFFSETTING, SIZE-VARYING, SKEWING, AND DISTORTING ADJUSTMENTS

BACKGROUND

1. Field of the Invention

This invention relates generally to toys or amusement devices for easily drawing a variety of complex, attractive designs; and more particularly to such a toy or amusement device capable of drawing a particular design twice or more, offset by fixed and controllable amounts to produce a compound design.

2. Prior Art

It is known to provide a toy or amusement device, for drawing designs, in which a paper carriage or platform rotates below a pen-holding arm while the arm performs various other motions that are coordinated with the rotation. Of course other drawing media may be substituted for paper, and other drawing implements for a pen.

Such devices usually produce designs made up of lobes repeated in a generally circular array, by virtue of the coordination between carriage rotation and arm motion. In prior devices of which I am aware, the coordination has been provided by a rotating eccentric that drives one end of the arm.

The eccentric is itself belt-driven from the carriage, either directly or indirectly. That is to say, the eccentric and the carriage each either themselves serve as driven and driving pulleys, or carry such pulleys, or are linked with such pulleys.

In such a device the number of lobes per revolution is nominally established by the ratio of diameters of the driven and driving pulleys. In an inexpensive belt-driven device this is very likely to be (or to soon become) an incommensurable number.

In other words, there will not be a rational number of lobes in each design. The pen does not come back around to the same place where it starts, closing the design, but rather continues in a new revolution of the carriage from a new starting point with some uncontrollable offset—which results automatically from operation of the device.

The results are often appealing, and are recognizable as a rotary form of Lissajous figure. The continual migration of the starting point on each rotation, and the resulting ever-denser appearance of the perpetual spiral, are fascinating to a person who has not seen them before.

It is a commonplace observation, however, that a person playing such a device tends to lose interest in it quickly. Here are two probable reasons for this rapid saturation of interest:

First is the nearly complete absence of opportunity for creative contribution by the user or player. Use is limited to continuous operation of the mechanism, to generate whatever pattern turns out to be produced, and to accepting the design as it comes out.

Second is the very fact that there is no stopping point. There is literally "no end to it," and most users probably feel compelled to get off an endless treadmill as soon as they realize they are on it.

In short, playing with such devices is boring and unending—surely a bad combination.

SUMMARY OF THE DISCLOSURE

First I shall present an informal orientation to my invention, emphasizing its conceptual elements. Subsequently I shall summarize the disclosure more formally.

My invention begins with the recognition of a principal reason for the limitation of prior devices described above: there is no way to *control* the relative alignment of the pen in each operation of the mechanism with its alignment in previous operations.

In particular, I have realized that the drawbacks of the prior devices arise because there is no finely controllable way to either:

(1) bring the pen around to its starting point at the end of each operation, to close the design; or (2) offset subsequent similarly closed designs by consistent, fixed increments.

In fact there is likely to be an unavoidable offset, of an uncontrollable and varying size, between the pen position at the beginning and end of each rotation. It is this offset that produces the already-described continual migration of starting point.

As the figure cannot be closed at the end of any number of rotations, however, a user is not regularly offered an opportunity for creative participation in the design-making. Furthermore, as a new closed figure cannot be begun with some systematically, neatly controllable offset from a previous one, a user has no ready mechanism for combining designs creatively to form compound designs.

Based upon these realizations, I have also taken further novel steps. I have developed a drawing device which *does* have a way to finely control the pen in successive operations.

This feature accordingly permits a user to produce compound designs using as many individual designs as desired, with finely controlled offsets between them, along the direction of operation of the paper carriage.

My invention is not limited to use in a rotary apparatus. When used in a rotary apparatus, however, it additionally provides a way to reliably return the pen to its starting point, to close each design. This feature is compatible with the introduction of a controllable offset between successive designs, along the direction of rotation (i.e., an angular offset).

Pursuing further the realization that prior devices were limited in opportunity for active creativity on the part of the user, I have also developed a drawing device with several operating adjustments or settings.

In exploring the results of the many different *combinations* of such adjustments or selections, a young child user's attention and interest can be drawn and held for many play sessions. Furthermore, upon perceiving such results, a person who is older and more observant and analytical will learn various principles of mechanics and geometrical relationships. These interest factors also extend the useful life of the device for each user.

Now based upon the foregoing informal introduction, a somewhat more rigorous summary of this disclosure follows.

My invention is an amusement apparatus, for use with paper or like drawing medium, and for use with at least one pen or a like drawing implement to draw designs on such a medium. I prefer to conceptualize the medium and the drawing implement as parts of the invention context, rather than the invention itself; but in some forms of my invention they may actually be built-in parts of the device.

The apparatus includes a base. It also includes a drawing-medium carriage. The carriage is movably mounted to the base for operation through a complete design-drawing motion, and adapted for carrying a drawing medium.

The apparatus also includes a drawing-implement arm. This arm has, at one location along the arm, at least one drawing-implement holder.

The holder is disposed generally adjacent to the carriage. The holder is disposed for marking by a drawing implement, when in place in a holder, on the drawing medium when in place on the carriage.

The drawing-implement arm also has, in another location along the arm, a motion-imparting fitting. At yet a third location along the arm, the arm has a longitudinal track.

In addition the apparatus of my invention also includes some means for defining an arm-pivot axis and for engaging the track. For the purpose of generality in expression of my invention, I shall refer to these means as the "arm-pivot-axis-defining and track-engaging means"—or sometimes more simply as the "defining and engaging means."

The defining and engaging means are mounted to the base. The arm-pivot axis which they define is fixed relative to the base.

The apparatus of my invention also includes some means for mechanically linking the carriage with the motion-imparting fitting, and for driving drawing-implement holder. Also for generality, I shall call these means the "linking means."

The linking means are supported from the base. They drive the implement holder in repetitive excursions. Each excursion defines an individual element of a design.

In this apparatus there is a fixed ratio between the number of design-element-defining excursions and the number of complete design-drawing motions. Furthermore, the linking means are manually offsettable, in defined fixed increments.

More specifically, the linking means can be offset manually for redrawing a particular design one or more times—offset in correspondingly defined fixed steps with respect to the direction of operation of the carriage. These "redrawn" designs are for combination with the already drawn particular design, to create a *compound* design.

The linking means include some means for defining the fixed increments. These latter means, again, I shall call the "fixed-increment-defining means" or just "defining means."

The foregoing paragraphs may summarize my invention in its most general or broad form. I prefer, however, to incorporate certain additional features or characteristics to enhance or optimize the benefits of the invention.

In particular I prefer that the fixed-increment-means include drive teeth that are defined on (or defining move in synchronism with) the carriage, and a toothed gear that is rotatably mounted to the base. The gear is engaged directly or indirectly (i.e., through intermediate gearing if desired) with the drive teeth, and carries at least one "eccentric drive means" for engaging the motion-conveying fitting on the arm.

I also prefer that the linking means be offsettable, in the previously mentioned fixed steps, by manual disengagement of the toothed gear from particular drive teeth, and manual reengagement of the toothed gear with other drive teeth—that are offset from the "particular drive teeth" by a fixed number of teeth.

Although my invention has good application to carriages driven linearly and in various kinds of regular and irregular motions, I prefer that the direction of operation of the carriage be rotary. In other words, I prefer to operate the carriage in rotation.

In this preferred embodiment of my invention, one complete design-drawing motion of the carriage is advantageously—but not necessarily—one rotation. Another attractive alternative, particularly for slightly older and more sophisticated users, is to make one complete design-drawing motion some other small but integral number (such as two to eleven) rotations.

When the carriage rotates thus, the individual design element defined by each excursion of the drawing-implement holder is one lobe of a circular array of lobes. A plurality of substantially similar lobes in such an array make up a single design.

Further in regard to rotary carriage operation, the ratio mentioned earlier is preferably—but again not necessarily—an integral number of pattern-element defining excursions of the drawing-implement holder for each complete design-drawing-motion of the carriage. Again, an alternative for greater subtlety and interest of operation is to make the ratio equal to the ratio of two integers: preferably two integers that are both relatively small.

For example, the ratio may be made seven to two (7/2), or thirty-five to eleven (35/11). With such ratios the apparatus will complete each figure after a relatively of rotations (such as two or eleven, in the small number examples just given).

Accordingly the number of lobes per rotation will be equal to the same ratio. In this way the implement holder returns substantially to a starting point at the end of a relatively small number of complete design-drawing motions, to form a continuous *closed* design.

Manual operation of the offsetting steps, with a rotary carriage, now produces a plurality of continuous and closed designs. These individual designs are offset in fixed steps along the direction of rotation of the carriage, to form a compound design.

All the steps can be uniform in size. That is, the size of each step can be consistent with the size of all the others. If preferred, however, sequential patterns of step size can be used, for interesting periodic effects in which gaps appear between groups of a number of individual patterns—or entirely arbitrary and random step-size sequences can be chosen to produce a user's desired effect.

Further developing my realization that design-drawing apparatus can engage a user's interest on a more protracted basis when the user can participate in controlling the results, as previously mentioned I have also provided several variable settings that can be incorporated in my invention.

In particular I prefer to include some means for displacing the position of the lobes radially, relative to a center of rotation of the carriage. I also prefer to include some means for varying the *size* of the lobes.

In addition it is advantageous to include some means for skewing the shape of the lobes about a rotational axis of the carriage—in effect superimposing an elliptical component upon circular motion produced by the eccentric drive It is also desirable to include some means for introducing an arbitrary distortion into the shape of the lobes.

All these variations help provide the user with opportunities for creative contribution to the result of operating the design-drawing apparatus. Accordingly they all may be used together or in various subcombinations with the benefit of making an apparatus that is particularly interesting and enjoyable to use, and therefore valuable.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 being mostly in section (along the compound line 2—2 in FIG. 1), and for clarity being split into two segments, with the left-hand half drawn above right-hand half;

FIG. 3 is a plan view, at approximately twice the scale of FIG. 1, of most of the working parts of the same embodiment;

FIG. 4 is a very greatly enlarged perspective view of the toothed edge of the paper carriage of the same embodiment;

FIG. 5 is a plan view of part of the same embodiment shown in FIG. 3, but with the optional triangular cam in use;

FIG. 6 is a like view with the optional oval cam in use;

FIG. 10 is a perspective view of a representative one of the program gears shown in FIGS. 1, 3, 5, 6 and 9;

FIG. 11 is a perspective view of the crank assembly shown in FIGS. 1, 3 and 9;

FIG. 12 is a sectional elevation through the center of the crank assembly, taken along the line 12—12 of FIG. 11;

FIG. 13 is a perspective view of the idler gears appearing in FIGS. 1, 3 and 9, with one of the gears drawn broken away to show its radial section;

FIG. 14 is a perspective view, on a reduced scale, of the drawing arm that appears in FIGS. 1, 3, 5, 6 and 9;

FIG. 15 is an elevation, in central longitudinal section, of the FIG. 14 arm;

FIG. 16 is a perspective view, on an enlarged scale, of the pivot-pin assembly shown in FIGS. 1, 3 and 9;

FIG. 17 is an elevation of the FIG. 16 pivot-pin assembly; and

FIG. 18 is a perspective view of the program-gear driver shown in those same drawings.

DETAILED DESCRIPTION OF THE PREFERRED EMBODIMENTS

Figure 1:
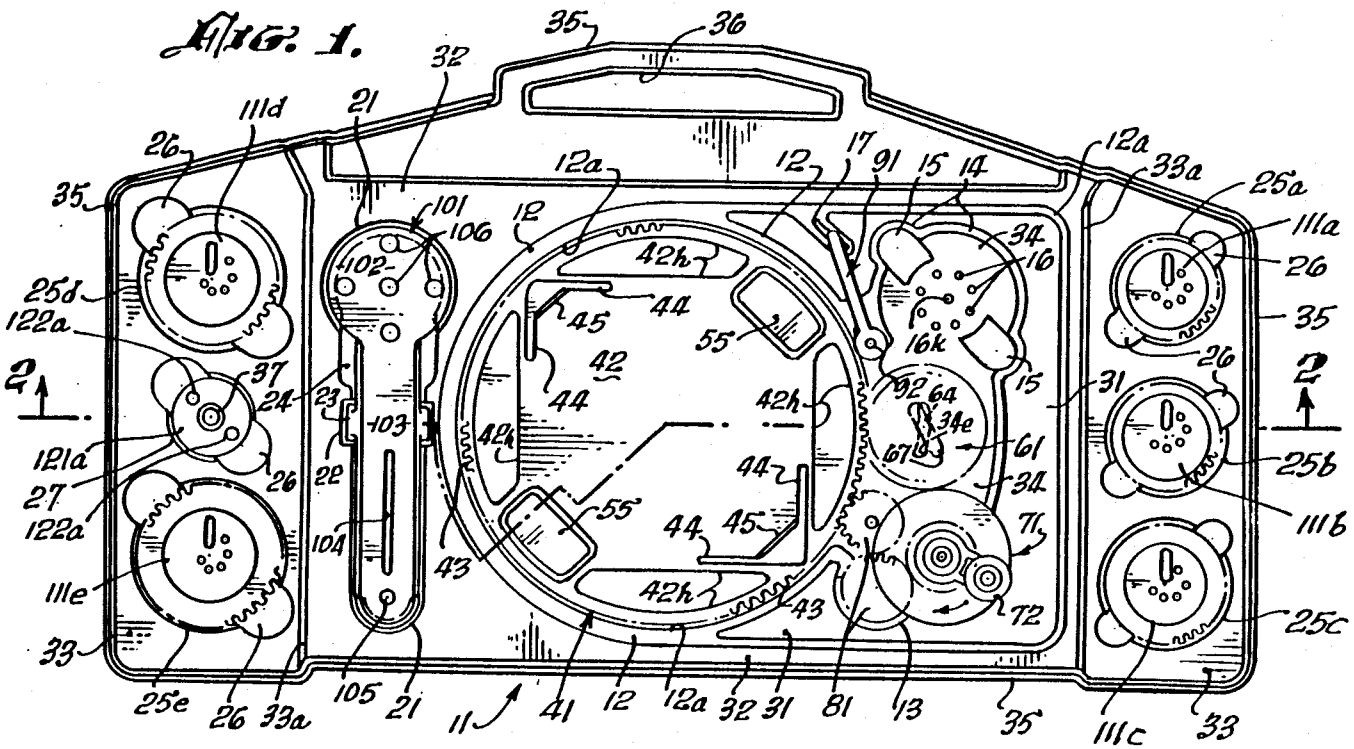
FIG. 1 is a plan view of a preferred embodiment of my invention.
Figure 2:
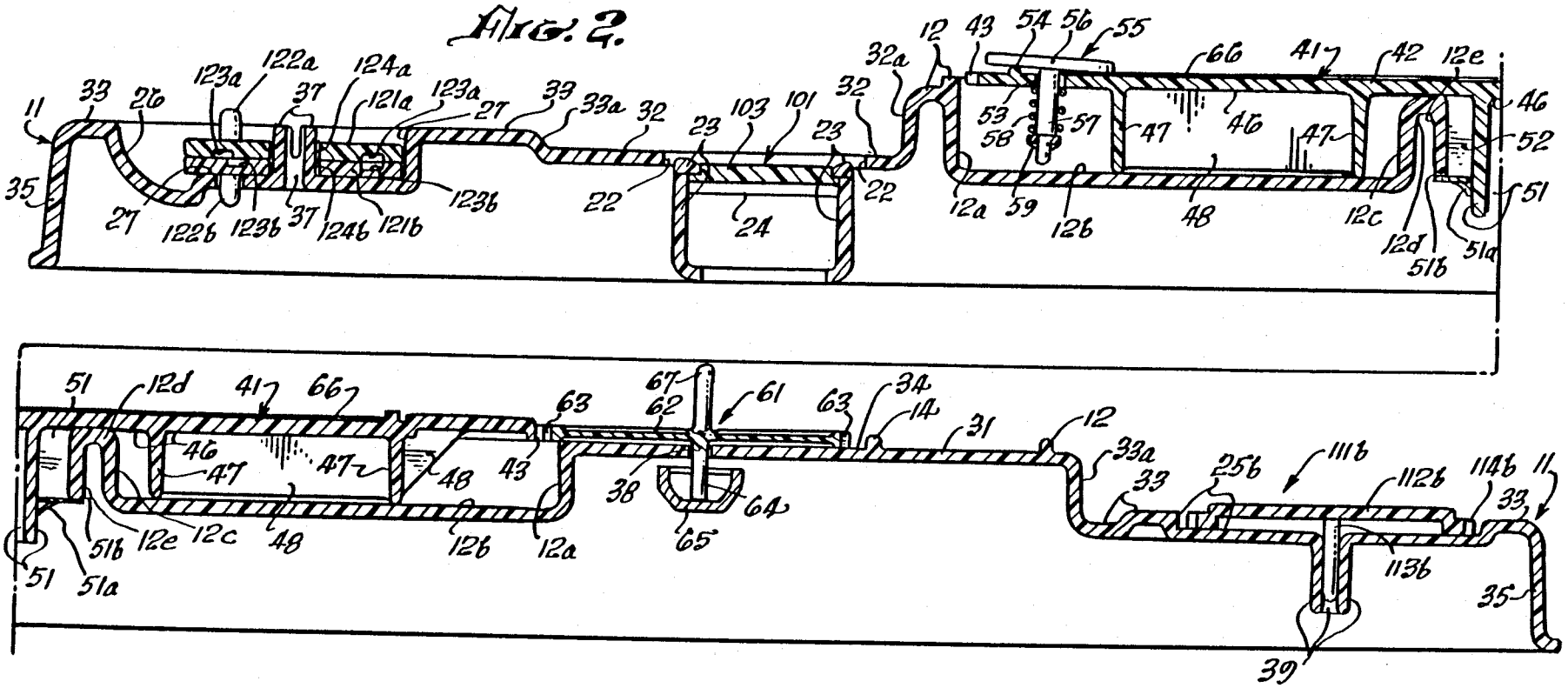
FIG. 2 is a greatly enlarged elevation of the FIG. 1 embodiment.
Figure 9:
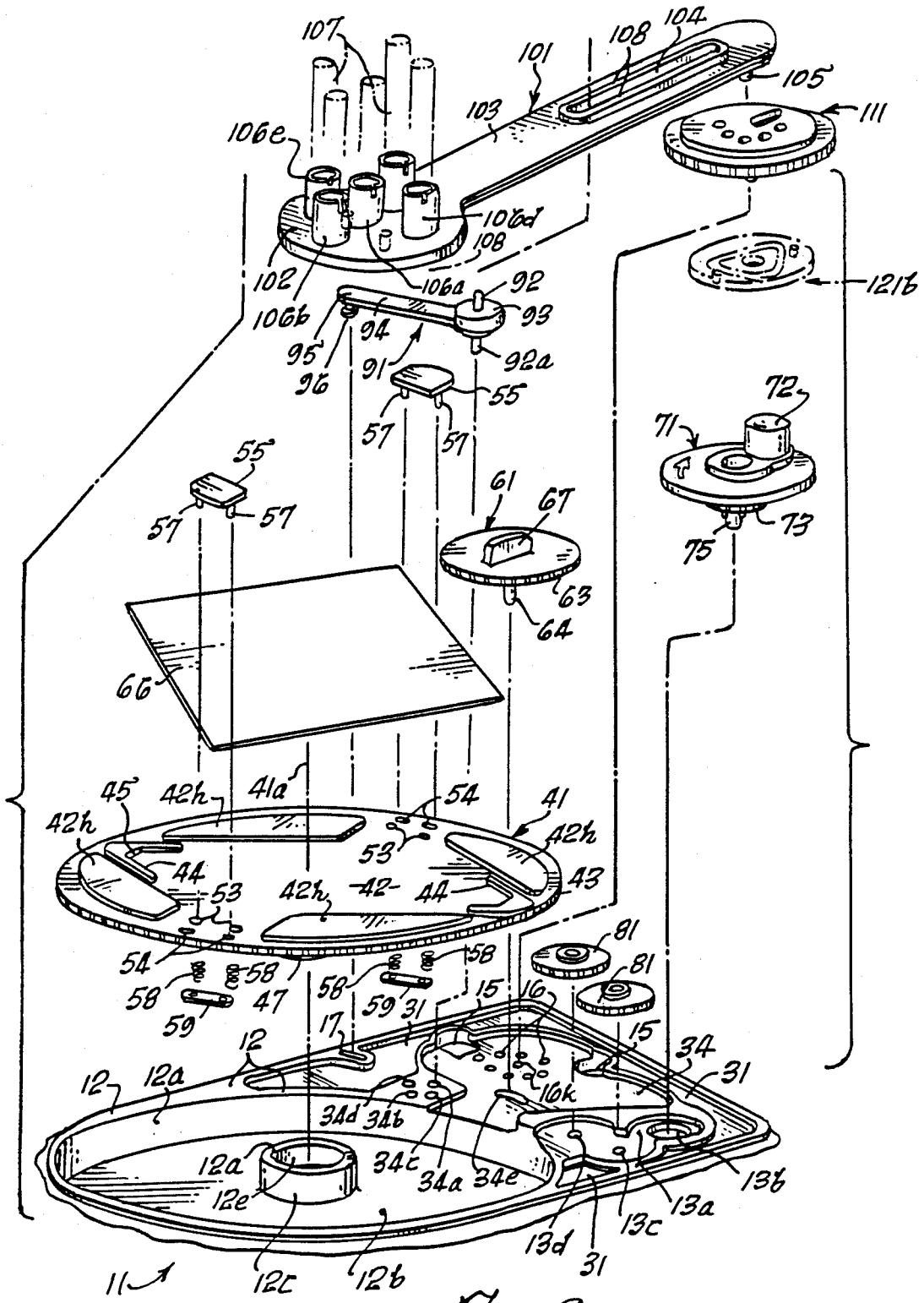
FIG. 9 is an exploded perspective view of the parts shown in FIG. 3.

As shown in FIGS. 1, 2 and 9, a preferred embodiment of my invention has a base 11. The base is formed from plastic into a complex but very generally flat shape.

The base has several generally planar portions 31, 32, 33 (at both left and right) and 34. These planar portions are at various heights and are separated from one another by some vertical steps 32*a*, 33*a* and by upstanding ridges 12 through 14.

The base 11 also includes a peripheral and generally vertical wall 35, which elevates all of these features above any underlying planar surface on the base 11 is placed. A formed slot 36 along one edge of the base 11 serves as a carrying handle.

The top surfaces of the base are also formed to define operating recesses 12*a*–12*b* (FIG. 9) and 13*a*, pivot holes or bearings 12*c* through 12*e*, 13*b* through 13*d*, and a mounting slot 17, for several moving parts that are shown (FIGS. 1 and 2) in operating position. These parts are respectively a carriage or turntable 41, a program-gear driver 61, a crank assembly 71, two idler gears 81, and a pivot-pin assembly 91.

The planar area 34 in the base 11 serves as an operating platform for the program-gear driver 61, and also for rotational mounting of any one of five program gears 111*a* through 111*e*. For these purposes a driver-gear pivot slot 34*e* and a corresponding program-gear pivot hole 16*k* are provided within the platform 34. As will be explained, the same portion of the platform 34 (surrounding the program-gear pivot hole 16*k*) that is occupied by a program gear 111 during operation can also be shared, whenever the user of the apparatus wishes, by either one of two program cams 121*a*, 121*b*.

The top of the base is also formed to define storage recesses 21–22, 25*a* through 25*e*, and 27, in the side platforms 33. These storage recesses include a longitudinal recess 21–22 that accommodates a drawing arm 101 when the arm is not in use.

Five relatively large circular recesses 25 accommodate the five program gears 111 respectively, when those gears are not in use. To stabilize the program gear 111*b* in storage, its shaft 113*b* (FIG. 2) is inserted into a downwardly projecting tubulation 39 formed in the center of the storage recess 25*b*, while the generally planar web 112*b* of the gear and its toothed periphery 114*b* rest in the recess 25*b* proper. Similar storage arrangements are provided for the other four program gears.

A smaller circular recess 27 similarly accommodates the two program cams 121*a* and 121*b*, one above the other as shown in FIG. 2. As the cams have no shafts, but only central holes, the storage recess 27 for the cams has an upwardly projecting tubulation formed in its center, to stabilize the cams in storage.

Each of the cams 121*a*, 121*b* has a respective pair of positioning pins 122*a*, 122*b*. For compact storage one gear, e. g. 121*b* as illustrated, can be oriented with its positioning pins 122*b* extending downward through matching small holes in the floor of the recess 27; while the other gear, e. g. 121*a* also as illustrated, can be positioned above the first-mentioned gear and oriented with the positioning pins 122*a* extending upward.

The program-gear platform area 34 and the six storage recesses 25 and 27 are each provided with a pair of molded access recesses 15, 26. These receive the user's fingers beneath the program gears 111 and cams 122, respectively, to facilitate lifting of the gears and cams from the base.

When in storage the drawing arm 101 rests upside-down upon a shelf 24, with the central segment 103 of the arm 101 retained between two spring clips 23. As shown in FIGS. 1 and 2, the inwardly facing retaining lip of each spring clip 23 is seated in a small step on a respective edge of the upwardly-facing underside of the arm 103. To free the arm 101 from storage, a user spreads the clips 23 into rectangular clearance holes 22 that are formed in the base area 32 for the purpose.

As previously indicated, my invention is not limited to use with paper carriages whose motion is rotary. As illustrated, however, I prefer to provide a paper carriage in the form of a turntable 41.

The turntable has a circular upper surface 42 with a toothed edge 43, and depending from its undersurface 46 a central tubular shaft 51 (FIG. 2) with four outwardly extending radial ribs or vanes 52 to serve as a bearing. The bearing 52 fits closely within a cylindrical bushing surface **12*e* integrally formed in the base 11**.

More particularly, the bush **12*e* extends downward from a narrow annular flange 12*d*, which in turn is supported on a cylindrical pillar 12*c* that is upstanding from the floor 12*b* of the turntable operating recess 12*a*–12*b*. Thus the bushing is in effect a strong, stiff double-walled structure 12*c*–12*d*–12*e*** to provide adequate stability for the compound-design drawing functions of the apparatus.

The vanes 52 extend downwardly just past the bottom of the bush **12*e*. A strong tang-type spring-metal clip 51*a* is forced onto the end of the turntable shaft 51 and upward against the bottom ends of the vanes 52**, to help retain the turntable in position during shipping and any later relocation of the apparatus.

The underside 46 of the turntable 41, in the annular area immediately surrounding the bearing vanes 52, is smooth and rides smoothly on the smooth upper annulus **12*d* 12*c*–12*d*–12*e***. This arrangement provides solid central support, relatively free of chatter that would otherwise interfere with the drawing of designs.

Coaxially surrounding the bearing 52 and also depending from the underside of the turntable 41 are two circular support rings 47, spaced radially outward from the bearing 52. These rings 47 have smooth lower edges that ride on the smooth planar floor **12*b* of the turntable operating recess 12*a*–12*b***.

The rings 47 are stiffened by radial ribs or struts 48, which also depend from the undersurface 46 of the turntable 41 but preferably stop short of engagement with the floor **12*b*. As illustrated, some of the struts 48 interconnect the two rings 48**, and some extend radially outward beyond the outer ring.

Two paper clamps 55 (FIGS. 1, 2 and 9) are mounted at diametrical positions on the turntable 41, to clamp two opposite corners of paper 66 to be positioned on the turntable. Each clamp 55 has a 9enerally planar upper body 56 and a pair of mounting pins 57. Each pin 57 projects downward through a respective hole 53 in the turntable 41, and below the turntable is encircled by a respective compression coil spring 58.

The remote lower segment of each pin 57 is of reduced diameter, separated from the upper full-diameter segment at an annular ledge. The reduced-diameter segment is sized to accept a single tang-type plastic clip 59 that spans both pins 57. This plastic clip 59 is forced over both reduced-diameter segments and upward against both annular ledges, to serve as a stop for both coil springs 57.

Each spring 58 accordingly forces the clip 59, and with it the bottom end of the associated mounting pin 57, downward away from the underside 46 of the turntable 41. The springs 58 thereby bias the bodies 56 of the clamps 55 downwardly against the top surface 42 of the turntable, or against any paper 66 placed under the edges of the clamps.

To enhance the paper-clamping action of the clamps 55, the outboard edge of each clamp is elevated above the upper planar surface 42 of the turntable by a pair of bosses 54 formed near the periphery of the turntable. The two bosses 54 associated with each clamp 55 act as a fulcrum for rotation of the body portions 56 of that clamp 55, allowing the inboard edge of that clamp to engage the paper 66 at a nonzero angle to provide a positive "bite."

Also formed in the upper surface 42 of the turntable 41 are paper-alignment ridges 44, and two slots 45 for insertion of corners of the paper. The corner-insertion slots 45 are mutually diametrical on the turntable 41, and are displaced at ninety degrees about the center of the turntable from the paper clamps 55.

As will be seen, the drawing arm 101 in operation extends over the periphery of the turntable. The corner slots 45 help to hold the paper down flat on the turntable, particularly preventing the unclamped corners from curling up into interference with the arm 101.

As shown in FIGS. 1, 2 and 9, the toothed edge 43 of the turntable 41 engages and drives a program-gear driver gear 61. This driver 61 (FIG. 18) has a generally planar body web 62, and mounts by its shaft 64 to the operating-platform area 34 of the base 11, along an arcuate slot **34*e***.

The shaft 64 passes vertically through the slot **34*e*. The lower end of the shaft 64 is held below the platform 34 by a clip or knob 65 (FIG. 2)—leaving the driver gear 61 and shaft 64 free to rotate, while constraining the shaft to travel along the slot 34*e*. Tooth motion tends to draw the driver 61 into position, but if desired the shaft may be user-clamped against the underside 34*u*** of the platform or spring-biased toward the rear of the apparatus.

The turntable 41 is driven by its toothed edge 43 from the hand crank assembly 71, through the two idlers 81. The crank assembly 71 includes a rotary handle 72 mounted eccentrically above a drive gear 73, and depending from the gear 73 an integral shaft 75. Like the turntable shaft previously discussed, the crankshaft 75 has integrally formed ribs or vanes 76 to act as a bearing.

This vane-type crankshaft bearing 76 rotates smoothly in a bushing **13*b* integrally formed in the operating-recess floor 13*a*. The bottom end of the crankshaft 75 is pinned below the base by a metal clip (not shown, but similar to that on the turntable shaft 51** previously discussed).

The crank handle 72 also has a ribbed shaft **72*b*, which extends in a close but smooth rotary fit through a crank-handle mount 72*a*. Below the mount 72*a*, the bottom end of the shaft 72*b* is retained by a metal clip 72*c***.

To minimize likelihood of injury to the user's fingers in operation of the crank, a protective broad shield or skirt 74 is integrally formed in the crank assembly 71. As best shown in FIGS. 11 and 12, the skirt is immediately below the crank-handle mount 72 and just above the gear 73.

One other component is shown in operating position in FIGS. 1 and 3—the pivot-pin assembly 91. This small but important assembly is shown separately in FIGS. 16 and 17, and also appears in FIG. 9.

The pivot-pin assembly 91 has an upward-projecting pivot pin 92, a downward-projecting locating pin **92*a*, and a body 93 disposed between the two pins. In addition the assembly 91 includes an elongated retaining arm 94, which at one of its ends is integral with the pivot-pin body 93**.

The retaining arm 94 also has another end 95, depending from which is a crescent-shaped anchor 96. The anchor is separated from the end 95 of the arm 94 by a short, slender clearance shaft 97.

The only components of the pivot-pin assembly 91 that are "working parts" with respect to the design-drawing functions of the apparatus are the two pins 92, 92*a* and the interconnecting body 93: their use will be explained shortly. The remaining portions of the assembly 91 merely function to deter inadvertent misplacement and loss of the In particular, when the crescent anchor 96 is roughly aligned with the slot 17 (and the elongate arm is perpendicular to the slot), the anchor can be inserted into the slot until is below the bottom surface of the base. Then it is only the clearance shaft that is actually within the slot itself, and the whole assembly 91 can be rotated into the position shown in FIGS. 1, 3 and 9.

With the assembly 91 in that position, the anchor 96 is crossed relative to the slot 17. This misalignment secures the assembly 91 to the base (until the user rotates the assembly back to the aligned position for removal), but allows ample freedom of movement for necessary manipulations of the assembly 91 as will be described.

Now in operation, a user selects one of the program gears 111 (a representative program gear 111 appears in FIG. 10), removes it from its respective storage recess 25 and positions it on the program-gear operating platform 34. In doing this it is generally necessary for the user to temporarily move the program-gear driver 61, along its guide slot 34*e*, away from the part of the operating platform 34 where the program gear 111 fits.

When the program gear 111 is in place, the user allows the driver 61 to return under spring action toward the program gear 111. If necessary the user also rotates the crank handle 72 and/or the vane handle 64 of the driver 61 to engage the teeth of the program gear 111 with those of the driver 61.

As seen in FIG. 10, a representative program gear 111 has a peripheral flange 112, a central hub 113, and a downward depending shaft 116. Thus in positioning the program gear 111 the user inserts the gear shaft 116 into the central hole 16*k* in the part of the platform 34 reserved for the program gear 111.

The gear teeth 115 are formed along the edge of the flange 112. The underside of the hub 113 is raised, as at 119, above the underside of the toothed periphery 115. Formed in the hub are several arm-drive holes 118*a*–118*e*, and a through-slot or arm-drive slot 114.

The process of gear selection and positioning establishes the number of design lobes that will be drawn by the apparatus, as the five program gears have different numbers of teeth and therefore different drive ratios with regard to the platform 11. This is so despite the presence of the program-gear driver 61 as an intermediary, because the driver 61 merely communicates the motion of the platform 41 to the program gear 111—with a change of direction, but unchanged in amplitude.

The first program gear 111*a*, stored in the upper right-hand (as drawn in FIG. 1) storage recess 25*a*, has sixty-three teeth; the second program gear 111*b* (in the center right-hand recess 25*b*) has sixty-six, and the third gear 111*c* in the lower right-hand recess 25*c* has seventy-two The fourth gear 111*d* (in the upper left-hand recess) has eighty-one teeth, and the fifth gear 111*e* (in the lower left-hand recess) has eighty-four. By comparison toothed periphery of the platform 41 has two hundred the fifty-two teeth.

Therefore each rotation of the platform 41 corresponds to four (252/52=4) rotations of the smallest program gear 111*a*, or to three (252/84=3) rotations of the largest program gear 111*e*. Each of these two program gears 111*a* and 111*e* thus produces an integral number (three or four) of lobes and will draw a figure that is self-connecting at the end of one rotation of the turntable.

From the data stated above it can also be seen that one rotation of the platform 41 corresponds to three and a half (252/72=3.5) rotations of the third program gear 111*c*. This nonintegral number of lobes results in a figure that is self-connecting at the end of two rotations of the turntable.

The resulting pattern will actually have *seven* lobes. Each rotation of the turntable draws three and a half lobes, positioned *halfway between* the three and a half lobes drawn on a previous or subsequent rotation.

Furthermore, one rotation of the platform 41 corresponds to three and one-ninth (that is, 3 1/9) rotations of the fourth program gear 111*d*, since 252/81=3.111 . . . , so with this gear the apparatus draws three and one-ninth lobes per revolution. The resulting pattern is self connecting after nine rotations of the platform, during which the apparatus draws a total of twenty-eight (3 1/9×9=28) lobes in progressively migrating positions at each rotation.

Finally, one rotation of the platform 41 corresponds to three and two-elevenths (that is, 3 2/11) rotations of the second program gear 111*b*, as 252/66=3.1818 . . . , so that there will be three and two-elevenths lobes per revolution. The resulting pattern is self connecting after eleven platform rotations, during which the apparatus draws thirty-five (3 2/11×11=35) lobes in progressively migrating positions.

To obtain any of these various patterns, the user must complete the assembly by properly arranging the pivot-pin assembly 91 and drawing arm 101. To prepare the pivot-pin assembly 91 for operation, the user simply inserts the locating pin 92*a* into any one of the four locating holes 34*a* through 34*d* (FIG. 9) formed in the base 11.

Two locating holes 34*a* and 34*b* are along the line of centers between the turntable axis 41*a* (FIG. 9) and the centerline of the program-gear pivot hole 16*k*. Selecting either of these two locating holes 34*a* or 34*b* for insertion of the locating pin 92*a* has the implication of selecting an individual lobe pattern that is symmetrical—not skewed either clockwise or counterclockwise about the turntable axis 41*a*.

Selecting the locating hole 34*a* that is closer to the *program-gear pivot hole* 16*k* is selecting a pivot point for working arm 101, as a lever, which reduces the mechanical advantage of the drive pin 105. As will be seen, such a selection has the implication of enlarging the excursions of the drawing pens, relative to the drive motion at the program gear (explained below). The result is to make the lobes larger.

Selecting the locating hole 34*b* that is closer to the turntable axis 41*a* has the opposite effect. That is, it increases the mechanical advantage at the drive pin 105 and thereby reduces the size of the designs generated.

The other two locating holes 34*c* and 34*d* are at an intermediate distance, relative to the distances between the turntable axis 41*a* and the first two locating holes 34*a* and 34*b* already discussed. Hence the designs generated using these holes 34*c* and 34*d* are of intermediate size.

Furthermore the locating holes 34*c* and 34*d* are displaced off the line of centers between the turntable axis 41*a* and the program-gear pivot hole 16*k*. Consequently, as will be seen, the motions described by the drawing pens in response to rotary drive motion at the program gear 111 are circles whose center is off the line of centers.

As a result the relationship between motion of the drawing pens and motion of the turntable 41 is not symmetrical on the two sides of the line of centers. Designs generated using these locating holes 34*c* and 34*d* are skewed clockwise or counterclockwise, depending upon the selection of a locating hole 34*c* or 34*d* that is displaced clockwise or counterclockwise from the line of centers.

With some experience, the user gains an intuitive feeling for the results to be obtained from selection among the locating holes. At the outset the user may simply insert the locating pin 92*a* into any of the four holes, and lower the underside of the pivot-pin assembly body 93 against the upper surface of the base.

Next, to install the drawing arm for use, the user frees the arm 101 from its storage recess 21 as previously described, inverts the arm to its right-side-up orientation, and positions the arm 101 on the apparatus as shown in FIG. 3. As shown more clearly in FIGS. 9, 14 and 15, the arm 101 has a working head 102, an elongated body 103 with an elongated central through-slot 104 along part of the body length, and at the end remote from the body 103 a drive pin 105.

The working head 102 carries five pen holders 106*a* through 106*b*, and on its underside a pair of depending bosses 109*a*, 109*b* for supporting the working head above the platform 41 or paper 66 when no pens are in the holders. The drive pin at the remote end of the body 103 depends downwardly along the centerline of the body 103.

The through-slot 104 is immediately surrounded by an upstanding reinforcing ridge 108, and is positioned by the user to engage the upstanding pivot pin 92 of the pivot-pin assembly 91. The working head 102 of the arm 101 is positioned generally over the paper 66 (or the area 42 of the platform 41 where the paper 66 will be).

Next the user inserts the downward projecting drive pin 105 into one of the previously mentioned drive holes 118*a* through 118*e* in the particular installed program gear 111. (In some cases, as will be seen, the drive pin 105 is inserted instead into the drive slot 114.)

As shown in FIG. 10, these various drive holes 118 are displaced from the center of the hub 113 by various radial distances, so that the radius of the circular motion imparted to the drive pin 105 varies correspondingly. (As previously suggested, the drawing arm 101 amplifies this motion, in inverse proportion to the mechanical advantage which the drive pin has relative to the drawing pens 106. That mechanical advantage is established in part by the selective positioning of the pivot pin 92 along the line of centers.)

In addition to their various radial distances from the center of the program-gear hub 113, the drive holes 118 are advantageously distributed circumferentially about that ceter—for example, arrayed in a spiral pattern as illustrated—so that they may be distinctly separated despite having only small differences, relative to their own diameter, in radial position.

When the drive pin 105 is inserted into any of the drive holes 118 in the program-gear hub 113, the motion imparted to the pin 105 and thereby to the drawing pens is substantially circular. The resulting patterns drawn on the paper, even when skewed by selecting off-center locating holes 34*c* or 34*d*, generally appear smooth and regular.

By use of a program cam 121*a* or 121*b*, in conjunction with any of the program gears 111*a* through 111*e*, the user may introduce noncircular motions at the drive pin 105 and thereby at the drawing pens. To do so the user places one of the program cams 121 on the operating platform before positioning the program gear 111 there; and then positions the gear 111 above the cam 121.

In installation of a cam 121, the positioning pins 122 of the cam are inserted into any of the four diametrical pairs of locating holes 16 in the operating platform 34. Selection of any one of the four pairs of locating holes 16 establishes and fixes one of four (with the oval cam) or eight (with the triangular cam) possible phase relationships between the noncircular motions of the drawing arm 101 and the rotation of the turntable 41.

The selected program gear 111 is then positioned above the cam 121, with the cam nesting into the recess 119 (FIG. 9) in the underside of the gear. While the locating pins 122 fix the cam 121 against rotation relative to the platform 34, the gear 111 is free to rotate above the cam. As before, the gear 111 rotates with its shaft 116—which now is inserted completely through a central hole 124 in the cam 121 and into the pivot hole 116*k*.

The drive pin 105 under the drive end of the drawing arm 101 ins then inserted completely through the drive slot 114 and into the noncircular-pattern cam slot 123 in the upper face of the cam. The overall arrangement is shown in FIGS. 5 and 6 for the triangular and oval cams 121*b* and 121*a* respectively. As the cam gear 111 rotates, the drive slot 114 forces the drive pin 105 to follow the cam slot 123.

When the parts are so arranged, the drive pin follows and traces out the arbitrary shape of the slot 123 formed into the top surface of the cam 121, rather than a circular shape, and the drawing pens follow suit—subject to the amplification and possible skewing mentioned previously.

Thus when the oval-slot cam 121 is in place, out its oval shape, magnified and possibly skewed; when the triangular-slot cam 122*fa* is used, the pens trace out its triangular shape, likewise magnified and possibly skewed.

It only remains to install one or more drawing pens 107 (FIG. 9) in the pen holders 106. As shown in FIGS. 1, 3, 9 14 and 15, there are five separate pen holders 106*a* through 106*e*, mounted in the working head 102 of the drawing arm 101. At any given time the user may employ any one pen holder or any combination of one or more of the pen holders 106.

One pen holder 106*a* is on the centerline of the arm, and at a distance from the drive pin 105 (at the other end of the arm) which is very nearly equal to the distance between the turntable axis 41*a* and the centerline of the program-gear pivot hole 16*k*. When this pen holder 106*a* is used, the resulting pattern is drawn closely about the turntable rotational axis.

Another pen holder 106*b* is also on the centerline of the arm 101, but closer to the pivot pin 105 than the "on center" pen holder 106*a*. When this second holder 106*b* is used, the pattern is drawn on the near side of the turntable axis 41*a*, and therefore bears a certain phase relation to the turntable motion.

In particular, when the arm moves toward the rear of the apparatus, it is traveling tangentially and in the same direction as the turntable, so its motion relative to the turntable, and as recorded on the paper, is foreshortened; and conversely. Moreover the pattern drawn is slightly smaller than with the "on center" holder 106*a*, by the shorter effective lever arm to this second holder 106*b*.

All these phase and size relationships are reversed when the user employs still another holder 106*c*, which is also on the arm centerline but is further from the pivot pin 105 than the "on center" holder 106*a*.

The remaining two pen holders 106*d* and 106*e* are displaced in opposite directions from the centerline, though at substantially the same distance from the pivot pin as the "on center" holder 106*a*. With these holders, some skewing of the resulting patterns is obtained, although it is of a different character than that which results from using the off-center locating holes 34*c* and 34*d* discussed earlier.

In addition, when these two frontward and rearward pen holders 106*d* and 106*e* are employed, two other phase relationships to the turntable 41 arise. For example, when the arm 101 moves rearward, the frontward pen holder 106*d* is traveling radially toward the center of rotation of the turntable, rather than circumferentially.

Its relative motion as recorded on the paper while the turntable rotates is neither foreshortened nor lengthened. Rather it appears as a curved line trending toward the center of the pattern.

All these relationships are reversed for the rearward pen holder 106*e*, which is also at the "on center" distance from the drive pin 105 but behind rather than in front of the drawing-arm centerline.

All the above-described features of my invention can be used to draw a design consisting of a single line which after some number of turntable rotations ranging from one to eleven will reconnect to itself at the starting point—forming a closed figure. This characteristic of my invention results from the use of carefully controlled tooth relationships, as previously explained.

Such a single-line pattern can be given any of a great variety of fascinating shapes, resulting from the interrelationships between the various selections made by the user. By way of summary, the user selects program-gear tooth count (five choices, in my preferred embodiment); drive hole on the program gear (five choices), or program cam (two choices) and its angular position on the platform (four distinct choices with the oval cam, eight with the triangular cam); pivot-pin locating hole (four choices); individual pen holder (five choices) or any combination of two or more pen holders (up to twenty-six choices).

The grand total, for even the modest number of choices which my preferred embodiment provides in each individual election, is $5\times(5+4+8)\times4\times5=1{,}700$ different possible operating conditions with a single pen. If multiple-pen combinations are taken into consideration, that number of conditions is $1{,}700/5\times(5+26)=10{,}540$.

This astronomical number of different operating conditions and therefore different visual effects, however, is only scratching the surface of what can be accomplished using my invention. The complete number is actually many times larger than that, because my invention is specifically intended for *combination* of numerous single-pen designs, or even numerous multiple-pen designs, to make extremely complex and intricate *compound* designs.

As previously explained, such compound designs can be produced by these steps in sequence:

(1) making one complete self-connecting design,
(2) lifting and removing the drawing arm and pen(s)
(3) disengaging the turntable teeth 43 from the program-gear driver teeth 63,
(4) offsetting the turntable 41 relative to the driver 61 by some particular number of teeth,
(5) reengaging the turntable teeth 43 with the driver teeth 63,
(6) repositioning the drawing arm and pen(s),
(7) making another complete self-connecting design, and finally
(8) repeating steps (2) through (7) as many times as desired, preferably using the same particular number of teeth for offset at iteration of step (4).

Steps (3) through (5) are facilitated by the vane handle 67 provided on the driver gear 61, to aid the user in raising that gear 61 very slightly so that its teeth 63 clear the turntable teeth 43. The driver-shaft retainer clip or knob 65 (FIG. 2) is given just sufficient clearance 65*c* below the undersurface 34*u* of the operating platform 34 to permit this maneuver, without releasing the turntable 41 or driver gear 61 from the base 11 and without fully freeing the driver shaft 64 from its mounting hole 38.

It will be appreciated that the vane handle 67 and the shaft clearance 51*b* are meaningful only in the context of this compound-design capability of my invention.

Steps (3) through (5) are also facilitated by indicia 42(FIG. 4) on the upper surface 42 of the turntable 41. These indicia are preferably provided in the form of either elevated ridges or scratch marks 43*i*, permanently and conspicuously formed atop and adjacent to each seventh tooth 43.

These indicia help the user to keep track of the tooth engagement used for each pattern, and thereby aid the user in offsetting the turntable teeth 43 relative to the driver teeth 63 by a particular number of teeth when desired. Here too, the indicia 43*i* take their significance from the compound-design drawing capability of my novel apparatus, which the indicia 43*i* facilitate.

Of course if deemed preferable it would be possible to substitute other periodicities for the indicia. For example, the indicia could be provided at every four, seven, eight or nine teeth—keeping in mind that an integral number of these cycles must be possible within the total number (e.g., for my preferred embodiment, two hundred fifty-two) of teeth 43 on the turntable.

The textural effects of the compound design produced by the apparatus in this way are strongly dependent upon the number of teeth used for offset in step (4), the degree of consistency (or other pattern) with which the size of the offset is reselected, and the number of repetitions.

Figure 7:
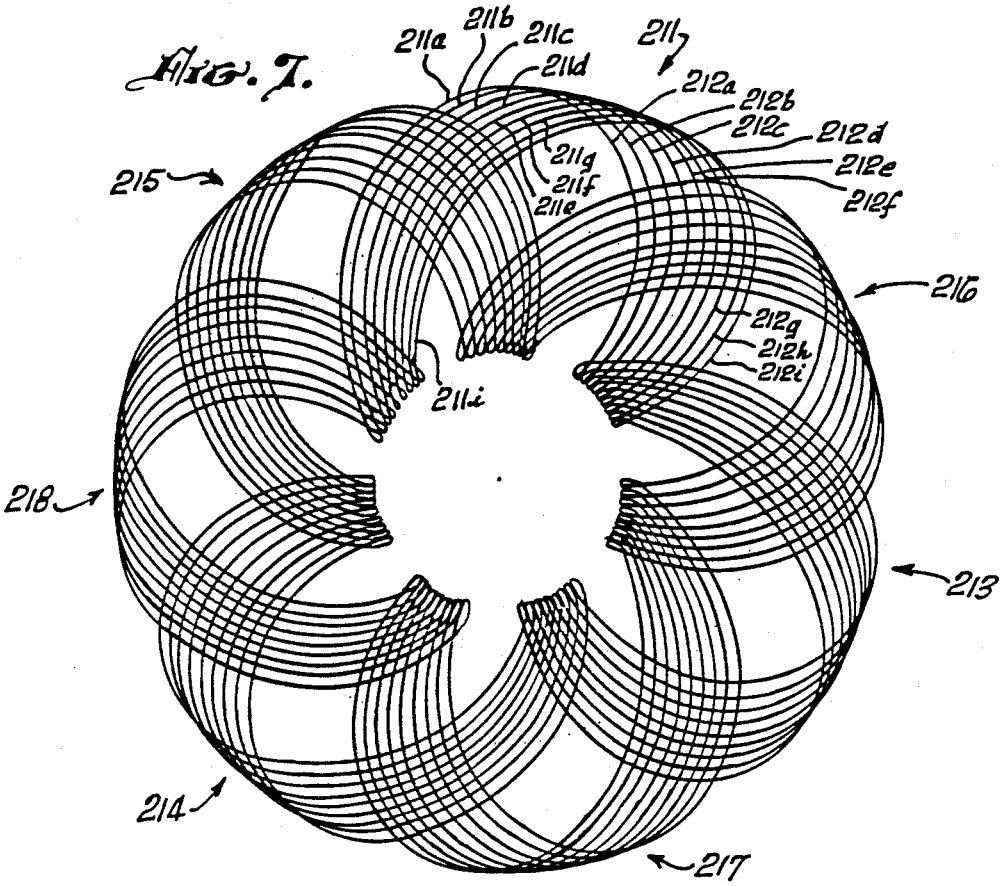
FIG. 7 is a representative reproduction of one kind of compound design that can be produced with the same embodiment, without either cam.
Figure 8:
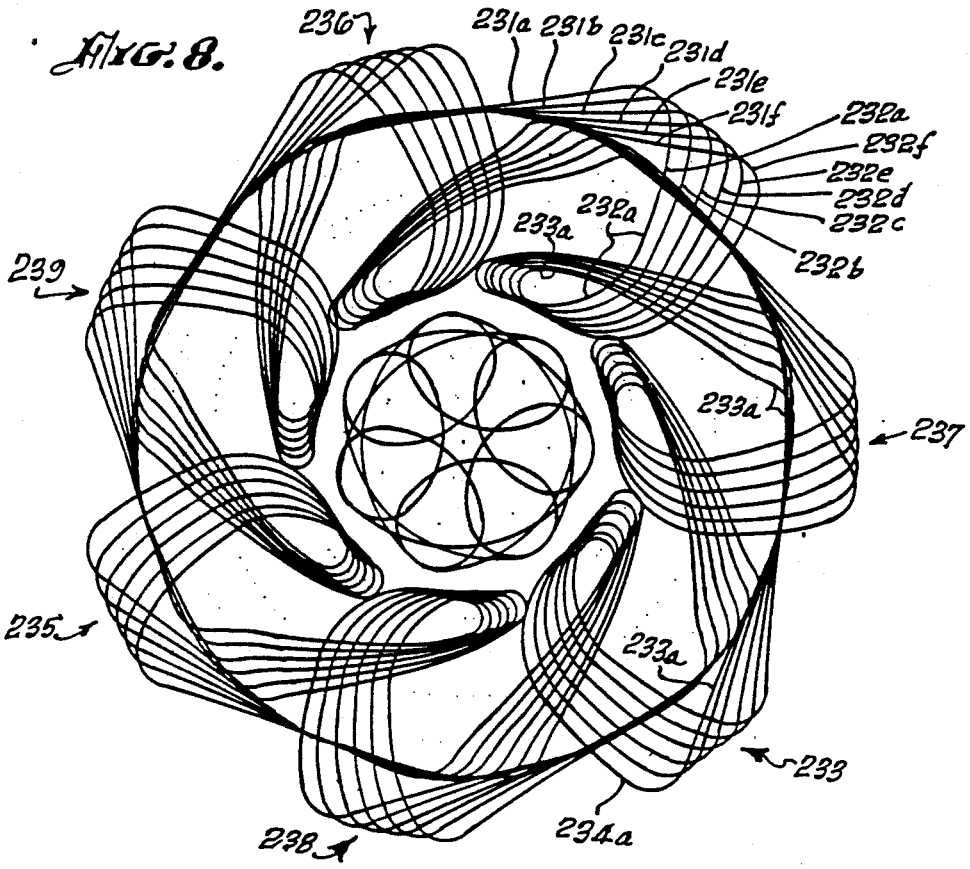
FIG. 8 is a representative reproduction of one kind of compound design that can be produced with the same embodiment, using the triangular cam.

Two such compound designs are shown in FIGS. 7 and 8. It will be understood that the designs illustrated may be further greatly elaborated by use of different-color pens for the various lines. That is, a pen with different ink color can be installed in the pen holder at, e.g., the time the platform 41 is offset relative to the driver 61.

From FIG. 7 it can be seen that a single line 211*a* which appears at the upper outside edge of the uppermost compound lobe 211 reappears at the inside edge of the same lobe 211 as line 212*a*. It then reappears alternately at the outside and inside edges of the successive lobes 213, 214 and 215.

The center of this last-mentioned lobe 215 is aligned with the beginning of the first-mentioned lobe 211. From this fact it is clear that there are exactly three and a half lobes per revolution, and therefore that the third program gear 111*c*, with seventy-two teeth, was used to produce this design.

This interpretation is confirmed by following the same line around the remaining three lobes 216, 217 and 218—which alternate with the earlier-mentioned lobes 211, 213 and 214—to its connection point with itself at the end of lobe 218. That end point is continuous with the starting point of lobe 211.

The next adjacent line 211*b*, as can be seen by measuring the design, is offset from the first line 211*a* by approximately one eighteenth of the circumferential travel required to execute one complete *lobe*. Since a travel of seventy-two teeth produces one lobe, the offset effected between drawing of the individual designs must have been four (72/18=4) teeth.

It can also be seen that the total number of lines used to make this design was nine, ranging from 211*a* through 211*i*, 212*a* through 212*i*, etc. The visual impact of this relatively large number of lines with offset of only four teeth is a rather fine-textured, "spun" effect, enhanced by the uncomplicated appearance of the unoccupied core of the design.

Through careful inspection of the design it can be verified that each lobe-line 211*a*–212*a*, etc., is asymmetrical—being distinctly skewed clockwise. This effect arises from using one of the off-center pivot-pin locating holes.

Very different effects are developed in the example of FIG. 8, even though the same program gear was used, producing the same number (seven) of lobes. Here only six lines were used in the outer design, apparently separated by about ten degrees—which corresponds to an offset of seven teeth between drawing of the individual designs.

A triangular cam was used to make the very angular, heavy-looking outer design in FIG. 8. The orientation or phasing of the cam is such as to produce a relatively long segment that is very nearly tangent to the circumferential motion of the paper, and these long segments in the individual lines have merged to create a nearly continuous-appearing, nearly solid septagon with rounded edges and corners. This very distinctive figure is located about two-thirds of the radial distance outward from the inner edge of the design to its outer edge.

A separate small design occupies the center of the outer design. This inner design is simpler, using just a single line, also with seven lobes but no cam distortion. The overall effect of these selections, contrasting in very different inner and outer designs, is coarse and surreal.

These two examples, out of the thousands that could be given, suffice to show the extraordinary power of the controllable offset, for drawing multiple compound designs.

A preferred feature of my invention is reference indicia on all of the various selectable components—the program gears 111, drive holes 118 on those gears, pivot-pin locating holes 34, and pen holders 106; and if desired the program cams 121 and program-cam locating holes 16.

In particular I prefer to mark each program gear 111 with large indicia 141 (FIG. 10)—such as the exemplary numerals "28" shown on the representative program gear 111—denoting the total number of lobes in a complete pattern made with the gear. I also prefer to identify the drive holes 118*a* through 118*d* on each program gear 111 with small indicia 142 such as numerals "1" through "5" as shown.

I prefer to mark the pivot-pin locating holes 34*a* through 34*d* with indicia "A" through "D" as in FIG. 9; and the pen holders 106 with "X" through "Z" as in FIG. 3.

Using these markings, a user ca record the selections used to draw a particular design, and then reproduce the same selections "by the numbers" to recreate that design.

The foregoing disclosure is intended to be merely exemplary, not to limit the scope of the invention—which is to be determined by reference to the appended claims.

I claim:

1. An amusement apparatus for use with a drawing medium and implement to draw a compound design made up of multiple angularly offset drawings of a particular complete continuous and closed design; said apparatus comprising:

a base;

a rotary carriage, for carrying such a drawing medium, mounted to the base for operation through a small number of rotations to form a complete closed design;

a drawing-implement are having:

at one location along the arm, a drawing-implement holder disposed generally adjacent to the carriage for marking by such an implement, when in place in the holder, on such medium when in place on the carriage, in another location along the arm, a motion-imparting fitting, and at a third location along the arm, a longitudinal track;

means, mounted to the base, for defining an arm-pivot axis fixed relative to the base, and for engaging the track; and means, supported from the base, for mechanically linking the carriage with the motion-imparting fitting;

said linking means including:

drive teeth defined on the carriage, a toothed gear rotatably mounted to the base, engaged directly or indirectly with said drive teeth to drive the carriage, and carrying at least one eccentric drive means for engaging the motion-imparting fitting on the arm to drive the drawing-implement holder in repetitive excursions that each define an individual lobe of a circular array of a plurality of substantially similar lobes forming a complete continuous and closed design, said toothed gear and its eccentric drive means establishing a fixed ratio between said plurality of lobes and said small number of carriage rotations, to form a complete continuous and closed design;

means for manually offsetting the toothed gear from the drive teeth on the carriage, by selectable increments consisting of a selectable integral number of said drive teeth; said manual-offsetting means including:

means for manual disengagement of the toothed gear from particular drive teeth, and manual reengagement of the toothed gear with other drive teeth that are offset from the particular drive teeth by said selectable integral number of said drive teeth, and means for facilitating consistent repetition of said offsetting by a selectable integral plurality of said drive teeth;

thereby to again form said complete continuous and closed design two or more times, offset in corresponding selectable increments of carriage rotation, for combination with said already formed complete continuous and closed design to create a compound design consisting of multiple drawings of the same complete continuous and closed design.

2. The apparatus of claim 1, wherein:

the manual-disengagement means comprise clearance in a mechanism by which said carriage is as foresaid movably mounted to the base, to allow temporary disengagement without entirely freeing the carriage from the base.

3. The apparatus of claim 1, wherein:

the facilitating means comprise indicia, associated with the linking means, for helping a user to see and keep track of said increments.

4. The apparatus of claim 3, wherein:

the indicia are associated with the drive teeth on the carriage.

5. The apparatus of claim 2, wherein:

the facilitating means comprise indicia, associated with the linking means, for helping a user to see and keep track of said increments.

6. The apparatus of claim 5, wherein:

the indicia are positioned adjacent to selected drive teeth on the carriage, said selected teeth being separated by a particular consistent number of teeth.

7. The apparatus of claim 1:

wherein the eccentric drive means carried by the toothed gear comprise:

a plurality of selectable holes formed in the toothed gear at respective plural radii for receiving the motion-imparting fitting of the arm to establish respective fixed radii for motion of said fitting, to impart to the implement holder a corresponding circular motion; said implement holder completing one said circular motion to form each lobe of the design; and a generally radial selectable slot, passing entirely through the toothed gear, for receiving the motion-imparting fitting of the arm for protrusion entirely through the radial slot; and further comprising a cam positioned below the toothed gear and fixed against rotation and having a cam groove, with a closed noncircular pattern, for receiving the motion-imparting fitting of the arm when said fitting protrudes through the radial slot to establish a nonfixed radius for motion of said fitting, said radius varying systematically with rotation of the toothed gear according to the closed noncircular pattern of said cam groove to impart to the implement holder a corresponding noncircular motion that is geometrically similar to the noncircular pattern of the cam; said implement holder completing one said noncircular motion to form each lobe of the design;

whereby a user may select for use either any of said selectable holes, or the radial selectable slot, at the user's preference, and may insert said fitting into the selected hole or slot as preferred, to obtain either a selected circular implement-holder motion of selected radius, or a selected noncircular implement-holder motion.

8. The apparatus of claim 7, wherein:

the cam is fixed against rotation in any of a plurality of selectable angular positions;

whereby through selection of different selectable angular positions for the cam a user changes the orientation of said noncircular motion relative to said lobes formed thereby, and accordingly changes the shape of said lobes.

9. The apparatus of claim 7, wherein:

the arm-pivot axis defining means fix the arm pivot at a position that is displaced from a line between the center of the carriage and the center of the toothed gear;

whereby said circular motion, or said geometrically similar noncircular-pattern motion, of the implement holder is skewed relative to the carriage rotation and correspondingly distorted in the drawn lobes.

10. The apparatus of claim 7, wherein:

the manual-disengagement means comprise clearance in a mechanism by which said carriage is as aforesaid movably mounted to the base, to allow temporary disengagement without entirely freeing the carriage from the base.

11. The apparatus of claim 7, wherein:

the facilitating means comprise indicia, associated with the linking means, for helping a user to see and keep track of said increments.

12. The apparatus of claim 11, wherein:

the indicia are associated with the drive teeth on the carriage.

13. The apparatus of claim 12, wherein:

the indicia are positioned adjacent to selected drive teeth on the carriage, said selected teeth being separated by a particular consistent number of teeth.

14. The apparatus of claim 1:

further comprising a multiplicity of selectable gears, having a respective multiplicity of different numbers of teeth for engagement with the drive teeth on the carriage, to establish a respective multiplicity of different available fixed ratios between said plurality of lobes and said small number of carriage rotations;

wherein the aforesaid toothed gear is any selectable one of said multiplicity of selectable gears; and wherein the eccentric drive means carried by the toothed gear comprises:

a plurality of selectable holes formed in the toothed gear at respective plural radii for receiving the motion-imparting fitting of the arm to establish respective fixed radii for motion of said fotting, to impart to the implement holder a corresponding circular motion; said implement holder completing one said circular motion to form each lobe of the design, and a generally radial selectable slot, passing entirely through the toothed gear, for receiving the motion-imparting fitting of the arm for protrusion entirely through the radial slot; and further comprising a plurality of selectable cams, each having a cam groove with a respective closed noncircular pattern, for receiving the motion-imparting fitting of the arm when said fitting protrudes through the radial slot to establish a non-fixed radius for motion of said fitting, said radius varying systematically with rotation of the toothed gear according to the respective closed noncircular pattern of said cam groove to impart to the implement holder a corresponding noncircular motion that is geometrically similar to the respective noncircular pattern of the cam; said implement holder completing one said noncircular motion to form each lobe of the design;

wherein a particular one of said plurality of selectable cams is positioned below the toothed gear and fixed against rotation, and its cam groove, with a particular closed noncircular pattern, is disposed to receive the motion-imparting fitting of the arm when said fitting protrudes through the radial slot, to impart to the implement holder a particular non-circular motion that is geometrically similar to the particular noncircular pattern of the slected cam;

whereby a user may select for use either any of said selectable holes, or the radial selectable slot, at the user's preference, and may insert said fitting into the selected hole or slot as preferred, to obtain either a selected circular implement-holder motion of selected radius or a selected noncircular implement-holder motion; and whereby a user may use a cam with a particular noncircular pattern with any of said selectable toothed wheels, and thereby may obtain a selected particular noncircular implement-holder motion in combination with any of said available fixed ratios.

15. The apparatus of claim 1, further comprising:

means for displacing the position of the lobes radially relative to a center of rotation of the carriage.

16. The apparatus of claim 15, wherein:

the displacing means comprise means for selectably mounting the drawing-implement holder at any of plural positions along the arm.

17. The apparatus of claim 15, wherein:

the displacing means comprise a plurality of selectable drawing-implement holders positioned at a corresponding plurality of positions along the arm.

18. The apparatus of claim 1, further comprising:

means for varying the size of the lobes.

19. The apparatus of claim 8, wherein:

the size-varying means comprise means for selectably mounting the arm-pivot-axis-defining and track-engaging means at any of plural positions, relative to the distance from a center of rotation of the carriage to a center of rotation of the linking-means toothed gear.

20. The apparatus of claim 1, further comprising:

means for skewing the shape of the lobes about a rotational axis of the carriage.

21. The apparatus of claim 20, wherein:

the skewing means comprise means for selectably varying the effective distance of the arm-pivot-axis-defining and track-engaging means from a geometric line between a center of rotation of the carriage and a center of rotation of the linking-means toothed gear;

wherein there is substantially no skewing when the arm-pivot-axis-defining and track-engaging means is substantially along said geometric line; and wherein the shape of the lobes is skewed in a direction and to a degree determined by the direction and magnitude, respectively, of displacement of the arm-pivot-axis-defining and track-engaging means from said geometric line.

22. The apparatus of claim 21, wherein:

the selectably varying means comprise a selectably usable plurality of arm-pivot-axis-defining and track-engaging means that are differently disposed with respect to said geometric line.

23. The apparatus of claim 21, wherein:

the selectably varying means comprise means for moving the arm-pivot-axis-defining and track-engaging means selectably to any of a plurality of positions that are differently disposed with respect to said geometric line.

24. The apparatus of claim 21, further comprising:

means for introducing an arbitrary distortion into the shape of the lobes.

25. The apparatus of claim 1, wherein:

the distortion-introducing means comprise a cam.

26. The apparatus of claim 1, wherein:

the track comprises a slot defined in the arm; and the pivot-point defining means comprise a positioning pin sized to fit closely within the slot, and a plurality of selectable mounting sites defined an the base for receiving the positioning pin.

27. The apparatus of claim 1, further comprising:

manually operable means for moving the carriage and the motion-conveying fitting in common.

28. The apparatus of claim 1, further comprising:

cam means for providing a drive ratio, between the carriage and the motion-conveying fitting, that varies during rotation of the carriage.

* * * * *